United States Patent [19]

Nalesnik

[11] Patent Number: 4,713,191

[45] Date of Patent: Dec. 15, 1987

[54] DIISCYANATE ACID LUBRICATING OIL DISPERSANT AND VITON SEAL ADDITIVES

[75] Inventor: Theodore E. Nalesnik, Wappingers Falls, N.Y.

[73] Assignee: Texaco Inc., White Plains, N.Y.

[21] Appl. No.: 946,750

[22] Filed: Dec. 29, 1986

[51] Int. Cl.[4] ..... C10M 133/16
[52] U.S. Cl. ..... 252/51.5 A
[58] Field of Search ..... 252/51.5 A, 51.5 R

[56] References Cited

U.S. PATENT DOCUMENTS

| | | | |
|---|---|---|---|
| 4,039,461 | 8/1977 | Hankins | 252/51.5 A |
| 4,482,464 | 11/1984 | Karol et al. | 252/51.5 A |
| 4,524,006 | 6/1985 | Sandel | 252/51.5 A |
| 4,663,064 | 5/1987 | Nalesnik et al. | 252/51.5 A |

*Primary Examiner*—William R. Dixon, Jr.
*Assistant Examiner*—Cynthia A. Prezlock
*Attorney, Agent, or Firm*—Robert A. Kulason; James J. O'Loughlin; Vincent A. Mallare

[57] ABSTRACT

A lubricating oil composition having improved dispersancy. The dispersant being prepared by coupling partially glycolated succinimides with an organic diisocyanate.

13 Claims, No Drawings

DIISCYANATE ACID LUBRICATING OIL DISPERSANT AND VITON SEAL ADDITIVES

BACKGROUND OF THE INVENTION

1. Field of the Invention

Internal combustion engines operate under a wide range of temperatures including low temperature stop-and-go service as well as high temperature conditions produced by continuous high speed driving. Stop-and-go driving, particularly during cold, damp weather conditions, leads to the formation of piston varnish and a sludge in the crankcase and in the oil passages of a gasoline or a diesel engine. This sludge and varnish seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkylsuccinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polymaine is attached directly to the alkenyl radical of the alkenylsuccinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

It is, thus, an object of this invention to provide a novel lubricating oil additive.

2. Disclosure Statement

U.S. Pat. Nos. 3,172,892 and 4,048,080 disclose alkenylsuccinimides formed from the reaction of an alkenylsuccinic anhydride and an alkylene polyamine and their use as dipersants in a lubricating oil composition.

U.S. Pat. No. 2,568,876 discloses reaction products prepared by reacting a monocarboxylic acid with a polyalkylene polyamine followed by a reaction of the intermediate product with an alkenyl succinic anhydride.

U.S. Pat. No. 3,216,936 discloses a process for preparing an aliphatic amine lubricant additive which involves reacting an alkylene amine, a polymer substituted succinic acid and an aliphatic monocarboxylic acid.

U.S. Pat. No. 3,131,150 discloses lubricating oil compositions containing dispersant-detergent mono- and dialkyl-succinimides or bis(alkenylsucinimides). Netherlands Pat. No. 7,509,289 discloses the reaction product of an alkenylsuccinic anhydride and an aminoalcohol, namely a tris(hydroxymethyl)-aminomethane. U.S. patent application, Ser. No. 334,774, filed on Dec. 28, 1981, discloses a hydrocarbyl-substituted succinimide dispersant having a secondary hydroxy-substituted diamine or polyamine segment and a lubricating oil composition containing same.

SUMMARY OF THE INVENTION The present invention provides a novel additive which improves the dispersancy of a lubricating oil. The lubricating oil composition comprises a major portion of a lubricating oil and a minor dispersant amount of a reaction product prepared by the process which comprises:

(a) reacting a polyethylene amine with an alkenyl succinic acid anhydride to form a bis-alkenyl succinimide;

(b) acylating said bis-alkenyl-succinimide with glycolic acid to form a partially glycolated bisalkenyl succinimide;

(c) adding an organic diisocyanate to said glycolated bis-alkenyl succinimide, thereby forming an diurea coupled glycamide bis-alkenyl succinimide; and (d) recovering said diurea coupled glycamide bisalkenyl succinimide.

DESCRIPTION OF THE INVENTION

The charge polyamine compositions which may be employed in practice of the process of this invention according to certain of its aspects may include primary or secondary amines. The amines may typically be characterized by the formula

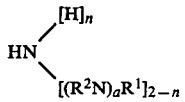

where a may be an integer of about 1 to about 6, preferably about 5; and n may be an integer of 0 or 1.

In the above compound, $R^1$ may be hydrogen or a hydrocarbon group selected from the group consisting of alkyl, aralkyl, cycloalkyl, aryl, alkyaryl, alkenyl, and alkynyl including such radicals when inertly substituted. When $R^1$ is alkyl, it may typically be methyl, ethyl, n-propyl, iso-propyl, n-butyl, i-butyl, sec-butyl, amyl, octyl, decyl, octadecyl, etc. When $R^1$ is aralkyl, it may typically be benzyl, beta-phenylethyl, etc. When $R^1$ is cycloalkyl, it may typically be cyclohexyl, cycloheptyl, cyclooctyl, 2-methylcyclo-heptyl, 3-butylcyclohexyl, 3-methylcyclohexyl, etc. When $R^1$ is aryl, it may typically be phenyl, naphthyl, etc. When $R^1$ is alkaryl, it may typically be tolyl, xylyl, etc. When $R^1$ is alkenyl, it may typically be allyl, 1-butenyl, etc. When $R^1$ is alkynyl, it may typically be ethynyl, propynyl, butynyl, etc. $R^1$ may be inertly substituted i.e. it may bear a non-reactive substitutent such as alkyl, aryl, cycloalkyl, ether, halogen, nitro, etc. Typically inertly substituted $R^1$ groups may include 3-chloropropyl, 2-ethoxyethyl, carboethoxymethyl, 4-methyl, cyclohexyl, p-chlorophenyl, p-chlorobenzyl, 3-chloro-5-methylphenyl, etc. The preferred $R^1$ groups may be hydrogen or lower alkyl, i.e. $C_1$—$C_{10}$ alkyl, groups including e.g. methyl, ethyl, n-propyl, i-propyl, butyls, amyls, hexyls, octyls, decyls, etc. $R^1$ may preferably be hydrogen. And, similarly, $R^2$ may be a hydrocarbon selected from the same group as $R^1$ subject to the fact that $R^2$ is divalent and contains one less hydrogen. Preferably $R^1$ is hydrogen and $R^2$ is $—CH_2CH_2$. Typical amines which may be employed may include those listed below in Table I.

TABLE I triethylenetetraamine (TETA)
tetraethylenepentamine (TEPA)
pentaethylenehexamine (PEHA)

The preferred amine may be tetraethylenepentamine.

The charge diisocyanates which may be employed in the practice of the presnt process may be characterized by the formula $$OCN—(R^3)—NCO$$

where $R^3$ is a hydrocarbon group selected from the group consisting of alkyl, aralkyl, cycloalkyl, aryl, alkaryl alkenyl and alkynyl.

In the practice of the process of this invention, the reagents are step wise reacted with a succinic acid anhydride bearing a polyolefin substituent containing residual unsaturation in a "one pot reaction".

The succinic acid anhydride may be characterized by the following formula

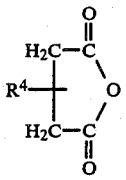

In the above formula, $R^4$ may be a residue (containing residual unsaturation) from a polyolefin which was reacted with maleic acid anhydride to form the alkenyl succinic acid anhydride. $R^4$ may have a molecular weight $\overline{M}_n$ ranging from about 500 to about 3000, preferably about 1000 to about 1300, and more preferably about 1300.

The diisocyanate coupled glycamide bis-alkenyl succinimide is prepared by the following sequence of steps in a single flask preparation as shown below in Scheme I. The first step of the reaction sequence involves reacting a polyethylene-amine with an alkenyl succinic acid anhydride (ASAA), respectively, in a 1:2 molar ratio to form the bis-alkenyl succinimide (A) intermediate. To this intermediate (A) is added enough glycolic acid to acylate all of the free basic amines except for one or one equivalent amine to form the partially glycolated bis-alkenyl succinimide (B). To this succinimide (B) is added a diisocyanate to form the diurea coupled glycolated bis-alkenyl succinimide (C).

The product so obtained may be a 50–80, say 50 wt. % solution of the desired additive in an inert diluent; and preferably it is used in this form.

SCHEME I

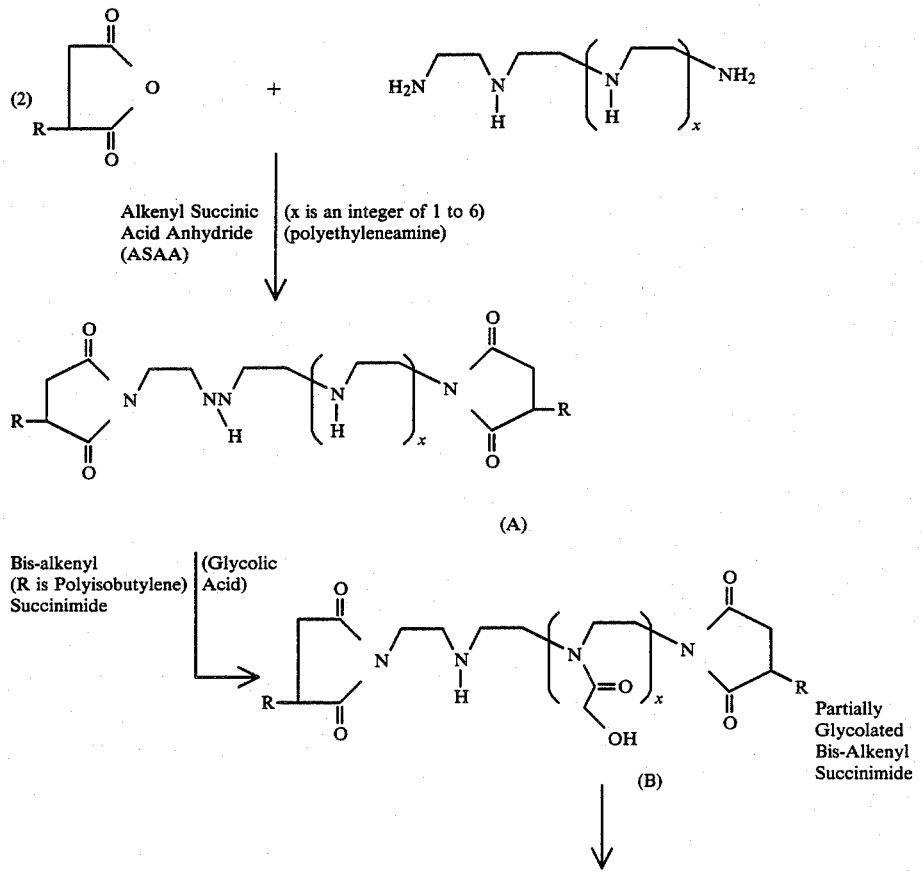

-continued

SCHEME I

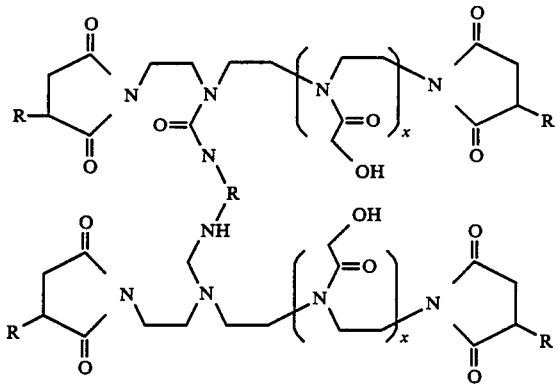

The preferred acylating agents which are carboxylic acids may be glycolic acid; oxalic acids; lactic acid; 2-hydroxymethyl propionic acid, or 2,2-bis (hydroxymethyl) propionic acid. The most preferred being glycolic acid.

Acetylation may be effected preferably by addition of the acetylating agent (e.g., glycolic acid or oxalic acid) to the reaction product of the polyethyleneamine and the succinic acid anhydride.

Acylation is preferably effected by adding the acylating agent (typically oxalic acid or glycolic acid) in an amount of about 0.5 to about 3.0 equivalents per mole of active amine employed.

For example, when tetraethylenepentamine (TEPA) is employed, there are 1.7 equivalents of glycolic acid added. Similarly, when triethylenetetramine (TETA) is used, about 0.7 equivalent of glycolic acid is added; and when pentaethylenehexamine (PEHA) is employed, about 2.7 equivalents of glycolic acid are added to the reaction.

During acylation, the carboxyl group of the acylating agent bonds to a nitrogen atom to form a urea. Acylating agent may also bond to a glycamide hydroxyl group to form a urethane. Acylation is carried out at 100° C.-180° C., say 160° C. for 2-24 hours, say 8 hours preferably in the presence of an excess of inert diluent-solvent.

The partially acylated product may in one of its embodiments be represented by the formula

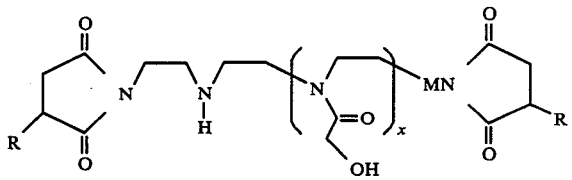

wherein R is polyisobutylene.

In order to illustrate the effectiveness of the present compounds, i.e., coupled glycolated succinimides, as dispersants, there are several tests to which the present succinimides have been subjected. These tests include the Bench VC and VD Tests. These tests are described below in more detail as well as the results of these tests provided below in Table II.

THE BENCH VC TEST (BVCT)

This test is conducted by heating the test oil mixed with a synthetic hydrocarbon blowby and a diluent oil at a fixed temperature for a fixed time period. After heating, the trubidity of the resulting mixture is measured. A low percentage trubidity (0 to 10) is indicative of good dispersancy while a high value (20 to 100) is indicative of an oil's increasingly poor dispersancy. The results obtained with the known and present dispersants are set forth in Table II at 10 percent by weight concentration respectivley, in an SAE 10W-40 fully formulated motor oil.

THE BENCH VD TEST (BVDT)

In the Bench VD Test, (BVDT), oil samples are artificially degraded by bubbling air for six hours through a mixture of test oil and synthetic blowby at 290° F. Every hour, synthetic blowby is added and at the 5th and 6th hour of the test, samples are removed and diluted with SNO-7/20 diluent oil and their turbidity measured. Low turbidity in the BVDT indicates good lubricant dispersancy as related to the Sequence VD Test.

TABLE II

BVDT[1] and BVCT Evaluations of GBSD[2] (coupled with organic Diisocyanates)

| | Dispersant[1] | BVCT[2] | BVDT[2] |
|---|---|---|---|
| I | GBS[3] (PEHA, H-300 ASAA) | 14 | 42 |
| II | GBS (PEHA, H-300 ASAA, Diisocyanatohexane) | 10 | 20 |
| III | GBS (PEHA, H-300 ASAA, Toluene Diisocyanate) | 15 | 35 |
| IV | GBS (TEPA, H-300 ASAA, fully glycolated) | 16 | 111 |
| V | GBS (TEPA, H-300 ASAA, fully glycolated, diisocyanatohexane) | 17 | 23 |

[1]Dispersants were evaluated in a fully formulated SAE 30 motor oil formulation.
[2]The lower the value the better the performance.
[3]GBS, glycolated bis-succinimide.

I claim:

1. A lubricating oil composition comprising a major portion of a lubricating oil and a minor dispersant amount of a reaction product prepared by the process which comprises:

(a) reacting a polyethylene amine with an alkenyl succinic acid anhydride to form a bis-alkenyl succinimide;

(b) acylating said bis-alkenyl-succinimide with glycolic acid to form a partially glycolated bis-alkenyl succinimide;

(c) adding a diisocyanate to partially or fully glycolated bis-succinimide thereby forming a diurea or respective urethane coupled glycamide bis-alkenyl succinimide; and (d) recovering said diurea or urethane coupled glycamide bis-alkenyl succinimide.

2. The lubricating composition of claim 1, wherein from about 0.5 to about 3.0 equivalents of glycolic acid are added per mole of polyethylene amine.

3. The lubricating composition of claim 2, wherein about 0.7 equivalents of glycolic acid are added per mole of triethylenetetramine.

4. The lubricating composition of claim 2, wherein about 2.7 equivalents of glycolic acid are added per mole of pentaethylenehexamine.

5. The lubricating composition of claim 2, wherein about 1.7 equivalents of glycalic acid are added per mole of tetraethylenepentamine.

6. The lubricating oil composition of claim 1, wherein said polyethylene amine is represented by the formula

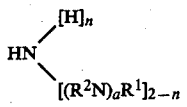

where $R^1$ is H or a hydrocabon selected from the group consisting of alkyl, alalkyl, cycloalkyl, aryl, alkaryl, alkenyl and alkynyl group; $R^2$ is a hydrocarbon selected from the same group as $R^1$ except that $R^2$ contains one less H; a is an integer of about 1 to about 6; and is 0 or 1.

7. The lubricating oil composition of claim 6, wherein said amine is selected from the group consisting of triethylenetetramine, tetraethylenepentamine and pentaethylenehexamine.

8. The lubricating oil composition of claim 7, wherein said amine is tetraethylenepentamine.

9. The lubricating oil composition of claim 7, wherein said amine is pentaethylenehexamine.

10. The lubricating oil composition of claim 7, wherein said amine is triethylenetetramine.

11. The lubricating oil composition of claim 1, wherein oxalic acid is substituted for glycolic acid.

12. The lubricating oil composition of claim 1, wherein said diisocyanate is selected from the group consisting of toluenediisocyanate and 1,6-cyanatohexane.

13. A lubricating oil composition comprising a major portion of a lubricating oil and minor dispersant amount of a reaction product prepared by the process which comprises:

(a) reacting an alkenyl succinic acid anhydride with a polyethylene amine

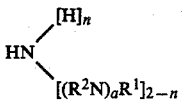

where $R^1$ is H or a hydrocabon selected from the group consisting of alkyl, alalkyl, cycloalkyl, aryl, alkaryl, alkenyl and alkynyl group; $R^2$ is a hydrocarbon selected from the same group as $R^1$ except that $R^2$ contains one less H; a is an integer of about 1 to about 6 and is 0 or 1, to form a bis-alkenyl succinimide

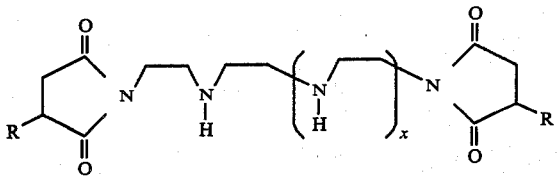

where R is polyisobutylene and x is an integer of 1 to 6;

(b) acylcating said bis-alkenyl-succinimide with glycolic acid to form a partially glycolated bis-alkenyl succinimide

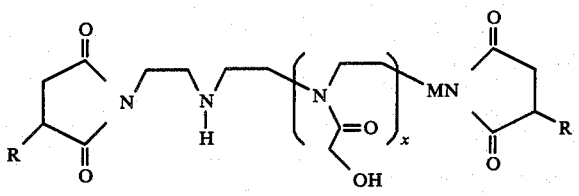

(c) adding a diisocyanate to said partially or fully glycolated bis-alkenyl succinimide thereby forming a diurea coupled glycamide bis-alkenyl succinimide

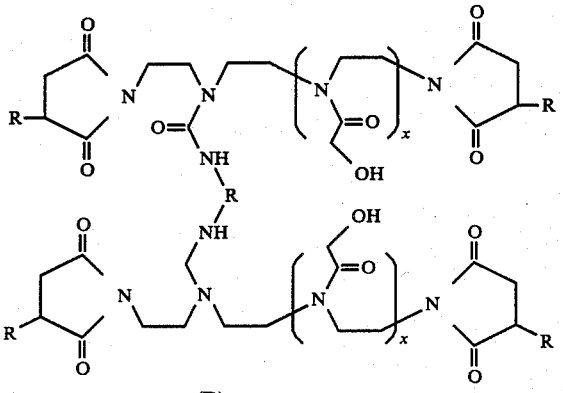

(D)
Diurea
Coupled
bis-alkenyl-succinimide and (d) recovering said acylated diurea coupled glycamide bis-alkenyl succinimide.

* * * * *